US009829011B2

(12) United States Patent
Larpent

(10) Patent No.: US 9,829,011 B2
(45) Date of Patent: Nov. 28, 2017

(54) FAN CLUTCH

(71) Applicant: MAHLE International GmbH, Stuttgart (DE)

(72) Inventor: Stephanie Larpent, Stuttgart (DE)

(73) Assignee: MAHLE International GmbH, Stuttgart (DE)

( * ) Notice: Subject to any disclaimer, the term of this patent is extended or adjusted under 35 U.S.C. 154(b) by 294 days.

(21) Appl. No.: 14/528,674

(22) Filed: Oct. 30, 2014

(65) Prior Publication Data

US 2015/0114791 A1 Apr. 30, 2015

(30) Foreign Application Priority Data

Oct. 30, 2013 (DE) ..... 10 2013 222 116

(51) Int. Cl.

| | |
|---|---|
| ***F04D 29/64*** | (2006.01) |
| ***F04D 29/32*** | (2006.01) |
| ***F04D 19/00*** | (2006.01) |
| ***F04D 25/02*** | (2006.01) |
| ***F01P 7/04*** | (2006.01) |
| ***F04D 29/26*** | (2006.01) |

(52) U.S. Cl.

CPC ..... *F04D 29/646* (2013.01); *F01P 7/042* (2013.01); *F04D 19/002* (2013.01); *F04D 25/02* (2013.01); *F04D 25/022* (2013.01); *F04D 29/263* (2013.01); *F04D 29/329* (2013.01)

(58) Field of Classification Search

CPC ..... F04D 29/646; F04D 29/329; F04D 25/022
USPC ..... 416/204 R, 209, 210 R, 169 A
See application file for complete search history.

(56) References Cited

U.S. PATENT DOCUMENTS 2,517,509 A * 8/1950 Sikorsky ..... B64C 1/00 123/41.11
3,075,691 A * 1/1963 Kelley ..... F01P 7/04 123/41.12
3,147,811 A * 9/1964 Klonoski ..... F04D 29/34 416/132 A
3,749,519 A * 7/1973 Ryba ..... F04D 29/023 416/241 A (Continued)

FOREIGN PATENT DOCUMENTS

CN 201730664 U * 2/2011 ..... F01P 7/02
DE 44 45 671 A1 6/1996

(Continued)

OTHER PUBLICATIONS

English Translation of DE 19618629.*
English translation of CN 201730664U.*

*Primary Examiner* — Woody Lee, Jr.
*Assistant Examiner* — Topaz L Elliot
(74) *Attorney, Agent, or Firm* — Muncy, Geissler, Olds & Lowe, P.C.

(57) ABSTRACT

A fan clutch, in particular for a fan of a cooling system of a motor vehicle having a housing and an annular flange for connecting the fan, wherein the flange is arranged centrally around a housing axis, wherein the flange forms a flat flange-ring plane substantially perpendicular to the housing axis and has a flange-ring inner side and a flange-ring outer side which bound the flange-ring plane, wherein the flange is contorted in the flange-ring plane in certain areas in a direction substantially parallel to the housing axis.

7 Claims, 6 Drawing Sheets

(56) References Cited

U.S. PATENT DOCUMENTS 4,169,693 A * 10/1979 Brubaker ..... B60K 11/00 416/169 A
4,384,824 A * 5/1983 Woods ..... F01P 5/02 123/41.11
4,511,310 A * 4/1985 Pearce ..... F04D 25/088 416/134 R
5,111,923 A * 5/1992 Kennedy ..... F16D 35/023 192/58.4
5,271,717 A * 12/1993 Sato ..... F04D 25/022 403/220
5,645,401 A 7/1997 Martin et al.
5,896,964 A * 4/1999 Johnston ..... F16D 37/02 192/21.5
6,468,037 B1 * 10/2002 Link ..... F04D 25/026 416/169 A
6,726,454 B2 * 4/2004 Blass ..... F04D 29/384 416/236 R
7,246,691 B2 7/2007 Lindauer et al.
7,980,373 B2 * 7/2011 Boyer ..... F16D 35/028 192/58.61
8,157,524 B2 * 4/2012 Nicgorski ..... F04D 29/663 416/169 A
8,408,371 B2 4/2013 Schultheiss et al.
2002/0141871 A1 * 10/2002 Medamaranahally F04D 29/023 416/193 R
2003/0231960 A1 * 12/2003 Asada ..... F04D 29/023 416/210 R
2007/0199784 A1 * 8/2007 Smith ..... F16D 37/02 192/21.5
2014/0064973 A1 * 3/2014 Ren ..... F04D 19/002 416/204 R
2015/0295487 A1 * 10/2015 Stagg ..... H02K 49/046 310/105

FOREIGN PATENT DOCUMENTS

DE 19618629 A1 * 11/1997 ..... F04D 25/022
DE 10 2004 008 861 A1 9/2005
DE 10 2008 035 185 A1 2/2010

* cited by examiner

FAN CLUTCH

This nonprovisional application claims priority under 35 U.S.C. §119(a) to German Patent Application No. 10 2013 222 116.9, which was filed in Germany on Oct. 30, 2013, and which is herein incorporated by reference.

BACKGROUND OF THE INVENTION

Field of the Invention

The invention relates to a fan clutch, in particular for connecting a fan of a cooling system to drive, such as an engine, in particular a motor vehicle engine, in particular for a motor vehicle.

Description of the Background Art

Fans are known, for example, in the form of axial fans and are used in motor vehicles for engine cooling, in particular in order to provide the engine compartment and the radiator with a sufficient quantity of air for cooling. This can be important when the vehicle is moving slowly or at standstill, as, particularly in these operating situations, the flow speed of the air and therefore the quantity of air can be too low due to the low vehicle speed.

The fan is connected to the engine of the motor vehicle by a fan clutch and is typically driven by means of the engine.

An axial fan for a radiator of a motor vehicle engine with a fan clutch, the fan hub of which is fixed by means of a fan flange on a clutch housing of a liquid friction clutch while leaving an annular gap, is disclosed in DE 44 45 671, which corresponds to U.S. Pat. No. 5,645,401, which is incorporated herein by reference. The liquid friction clutch can be driven by a drive part of the motor vehicle engine. An air guide ring, which has an arc-shaped profile which is axially opposed to the flow direction and curved radially inwards, is provided on the fan hub on an inlet side referred to the flow direction of the air flow.

A liquid friction clutch for a motor vehicle fan is disclosed in DE 10 2004 008 861 A1, which corresponds to U.S. Pat. No. 7,246,691, which is incorporated herein by reference. The clutch has at least one rotatably mounted shaft, on which is mounted at least one input drive body in a fixed rotational relationship. A clutch region, which accommodates a viscous fluid and by this means is able to transmit a torque between the input drive body and the output drive body, is provided between the input drive body and the output drive body.

DE 10 2008 035 185 A1, which corresponds to U.S. Pat. No. 8,408,371, which is incorporated herein by reference, and which relates to a fan clutch to which a fan is releasably fixed by means of a flange ring. The fan clutch has a housing comprising a first front housing part and a second rear housing part to which the flange ring can be fixed by means of connecting elements.

SUMMARY OF THE INVENTION

It is therefore an object of the invention to provide an improved fan clutch for a fan, in particular ring fan, and an improved fan.

In an exemplary embodiment according to the invention, the fan clutch, which is designed particularly for a fan of a cooling system of a motor vehicle engine, has a housing and an annular flange for connecting the fan, wherein the flange is arranged centrally around a housing axis, wherein the flange forms a flat flange-ring plane perpendicular to the housing axis and has a flange-ring inner side and a flange-ring outer side which bound the flange-ring plane, wherein the flange is contorted in the flange-ring plane in certain areas in a direction parallel to the housing axis.

Here, the flange plane is preferably arranged substantially perpendicular to the housing axis. The flange ring is preferably curved in a direction parallel to the housing axis at least in certain areas. The flange ring therefore has two flange planes perpendicular to the housing axis which are connected to one another. A gap can be produced due to the contortion of the flange. In particular, the gap is formed between some ribs of the fan and the flange.

In the conventional art, all ribs rest against the flange and therefore do not form a gap. As a result of the gap, the full height of the ribs can be used for cooling the fan clutch on its rear side. In doing so, a smaller or lower amount of air can be displaced at the flange when the fan is running. This preferably enables a better utilization of a rib height on the rear side. The fan clutch can be cooled better overall, in particular on its rear side. Further, the flange can be improved with regard to its strength properties in that the rigidity can be increased.

In an exemplary embodiment, the flange-ring plane has a substantially step-shaped form, wherein a first flange-ring plane and a second flange-ring plane are connected by means of an angled plane. This enables defined geometric gaps to be realized. Further, a flange ring of this kind is easy to manufacture.

In another embodiment of the fan clutch, the flange-ring plane can have a substantially wave-shaped form. Here, the flange-ring plane has wave troughs and/or wave peaks which preferably include flat sections. The flat sections form the first flange-ring plane and the second flange-ring plane respectively. The transitions between the first flange-ring plane and the second flange-ring plane are stepless and preferably have no edges, steps and/or corners.

Recesses, which are formed substantially uniformly over the circumference, can be arranged on the flange-ring inner side. As a result, the position of the connecting points of the fan clutch to the flange can remain unchanged relative to the flange which is not contorted. As a result, it is not necessary to make structural changes to the fan clutch, and the contorted flange can simply be integrated into the applicant's already known and used fan clutch.

In an embodiment, the flange-ring outer side can have projections and/or recesses which are distributed substantially uniformly over the circumference. The projections and/or recesses can be arranged in addition to the projections and/or recesses on the flange-ring inner side.

The projections and/or recesses can be formed in the flange-ring plane. In particular, the projections and/or recesses can extend over the full thickness of the flange-ring plane.

The object is further achieved with a cooling system for a motor vehicle which has a fan and a fan clutch according to the invention which is used to connect the fan to a drive axis of an engine, in particular of a motor vehicle. Here, the annular flange is arranged between the fan clutch and a sleeve ring with fan blades fixed thereto. The input drive energy of a crankshaft of the engine is preferably transmitted by means of the shear friction of an oil on the output drive side of the fan clutch which is connected to the fan. The input drive side can be driven by the rigidly connected flange shaft and a primary disk of the crankshaft or an intermediate belt drive. Here, a secondary side, for example a housing which encompasses the primary disk, can be supported on the flange shaft by means of a bearing. The housing and the fan mounted thereon can rotate at the secondary or fan speed. By means of an opening, in particular the gap between the fan clutch and the flange, air from the fan pressure side can flow back to the fan suction side at this point. This enables part of the fan clutch on the pressure side to be cooled.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
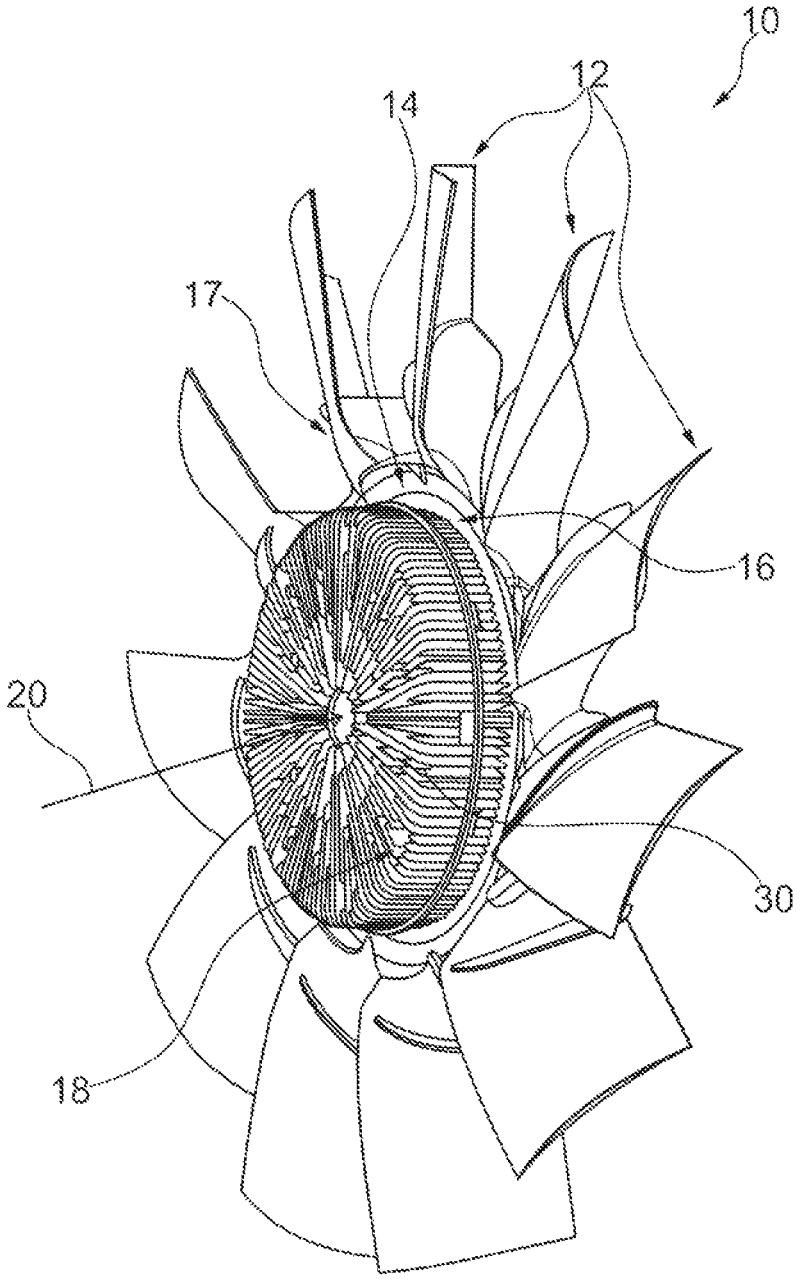
Fig. 1 Prior Art
FIG. 1 shows a conventional fan.

FIG. 1 shows a fan 10 according to the conventional art in a perspective view. The fan 10 is preferably designed as a ring fan, in particular as an axial fan. The fan 10 is part of a cooling system (not shown) for an internal combustion engine of a motor vehicle. The fan 10 has fan blades 12 which are arranged on a sleeve ring 14. The sleeve ring 14 is movably connected by means of a fan clutch 17, which is arranged in a housing 18 and of which only a flange 16 is shown, to a drive shaft (not shown) which is mounted along a housing axis 20.

Figure 2:
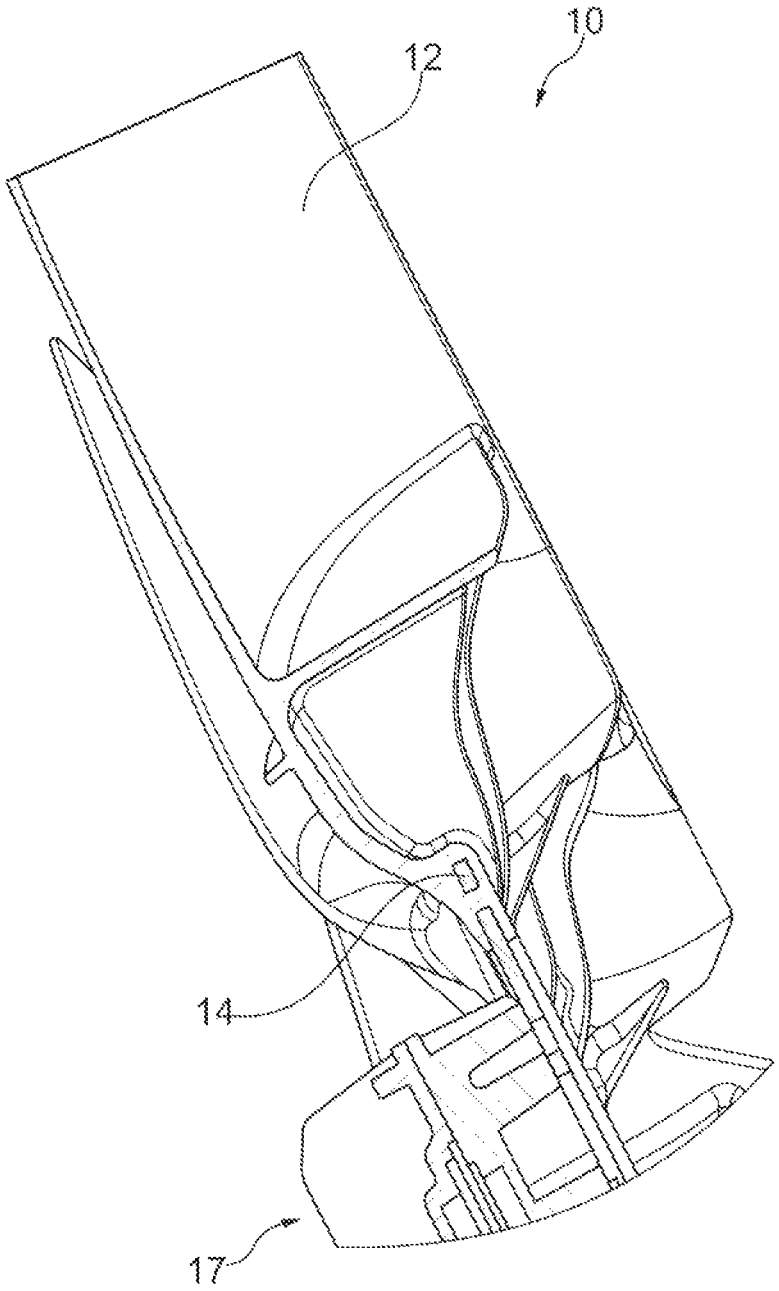
Fig. 2 Prior Art
FIG. 2 shows a section of the fan from FIG. 1.

In a schematic view, FIG. 2 shows a section of the fan 10 from FIG. 1, more accurately of one of the fan blades 12 which is arranged on the sleeve ring 14. The fan clutch 17 is arranged between the sleeve ring 14 and the drive shaft (not shown) which runs substantially on the housing axis 20.

Figure 3:
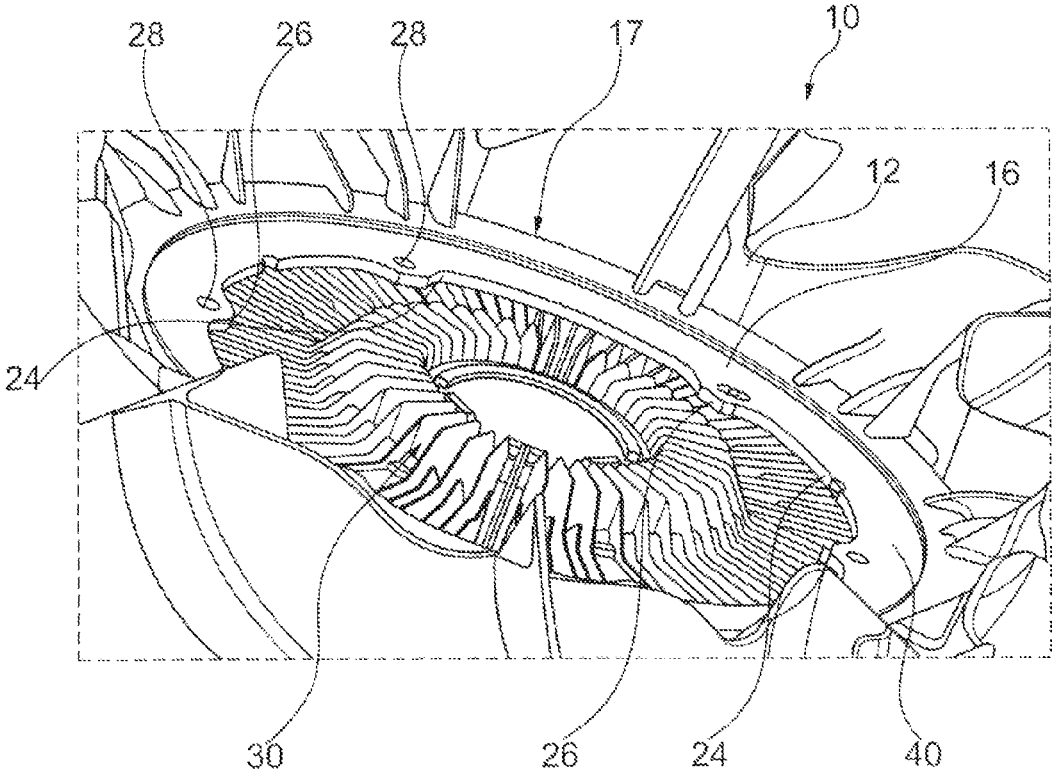
Fig. 3 Prior Art
FIG. 3 shows the fan of FIG. 1 in a perspective view.

FIG. 3 shows the fan 10 according to the prior art in perspective view looking at the rear of the fan 10. The flange 16 is part of the fan clutch 17 which is formed in particular as a friction clutch or viscous coupling. The flange 16 is designed as a flat ring and, on a flange-ring inner side 24, has projections 26 with openings 28 or recesses 28 which are designed to accept screws (not shown). Ribs 30, in particular cooling ribs, are arranged in the form of a circle around the housing axis 20. The ribs 30 rest against the flange 16.

Figure 4:
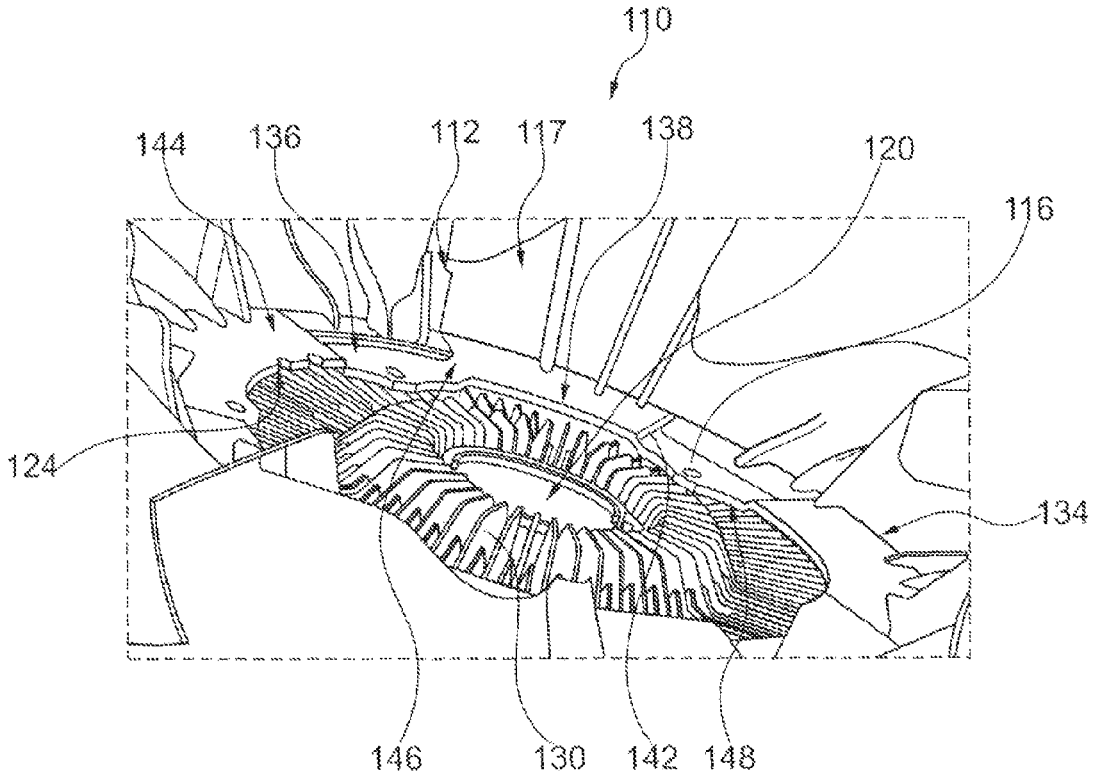
FIG. 4 shows a fan according to an embodiment the invention.

FIG. 4 shows a fan 110 with fan blades 112 according to the invention. The fan 110 is shown schematically looking at the rear of the fan 110. The housing axis 120, which is shown by a dot, runs centrally through the fan 110. As well as the flange-ring inner side 124, the flange 116 has a flange-ring outer side 134, wherein a first flange-ring plane 136 and a second flange-ring plane 138 extend between the flange-ring inner side 124 and the flange-ring outer side 134. The two flange-ring planes 136 and 138 are brought about by a contortion of the flange 116 in a direction parallel to the housing axis 120.

On the other hand, the flange 16 according to the prior art, shown in FIG. 3, has only one planar flange-ring plane 40.

Seen with respect to a direction parallel to the housing axis 120, the second flange-ring plane 138 is arranged at a distance from the first flange-ring plane 136. The two flange-ring planes 136 on 138 are connected by means of a flange-ring section 142. The flange-ring plane 136, the angled flange-ring sections 142 and the flange-ring plane 138 therefore form a continuous flange-ring surface 144. In the exemplary embodiment of FIG. 4, the flange-ring section 142 is formed as a sloping surface 146 or angled plane 146. However, the flange-ring section 142 can also be formed as a step with a surface running substantially perpendicular to the flange-ring planes 136 and 138.

In an embodiment, the flange-ring surface 144 can also be designed in the form of a wave, wherein the flange-ring plane 136 is formed by wave troughs and the flange-ring plane 138 by wave crests. Here, the wave troughs and the wave crests preferably have a substantially flat, planar plateau and thus form the flange-ring planes 136 and 138.

As a result of the contortion and the design of the two flange-ring planes 136 and 138, a gap 148 is formed between the ribs 130 and the flange 116.

Figure 5:
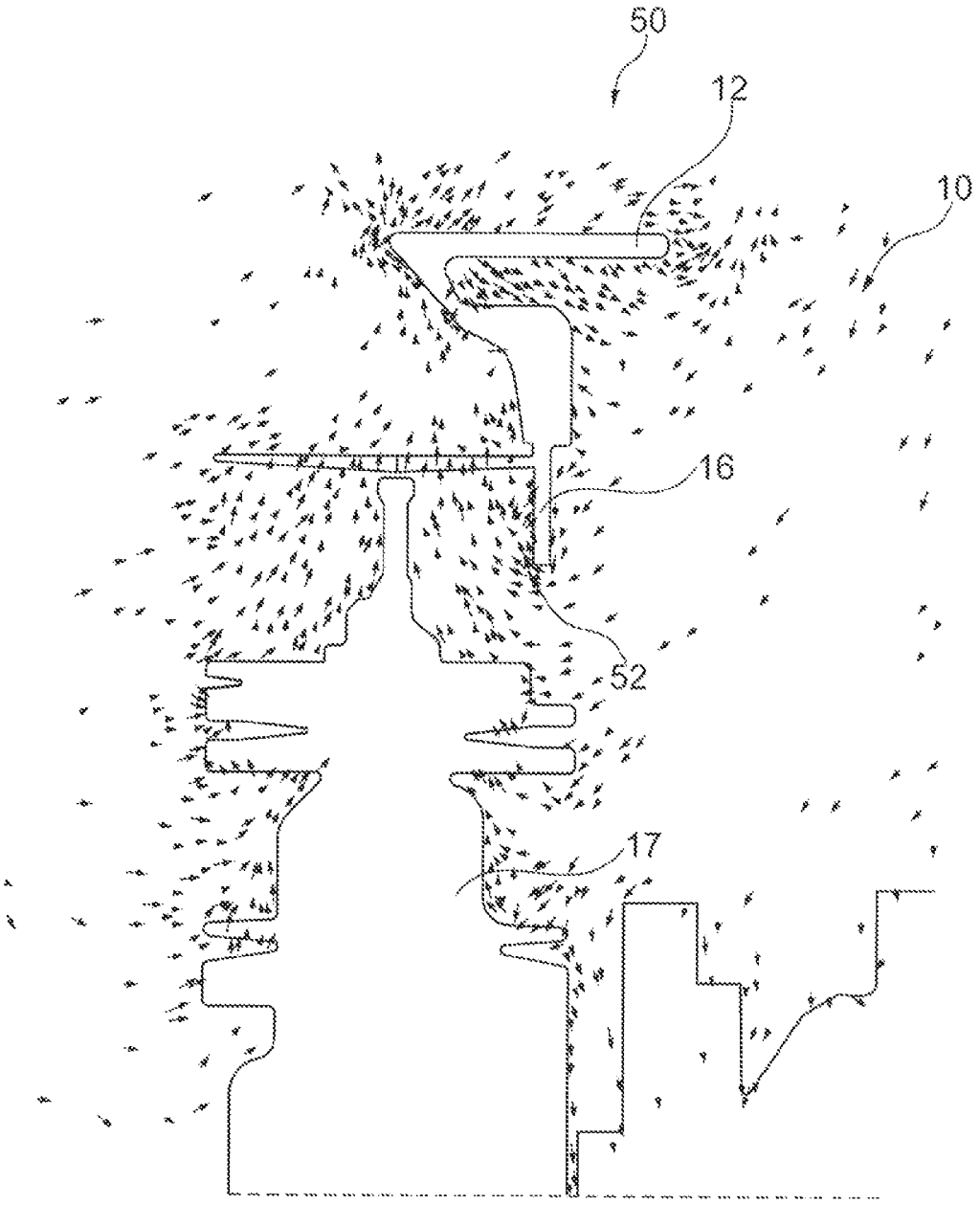
Fig. 5 Prior Art
FIG. 5 shows a flow simulation in the fan according to the conventional art.

FIG. 5 shows a flow simulation 50 in a sectional view in the fan 10 according to the prior art. The fan blades 12 of the fan 10 and the flange 16 are shown schematically. The flange 16 is part of the fan clutch 17. The air flow is shown by arrows. A displacement of the air marked with arrows 52 can be seen at an edge of the flange 16. The height of the ribs is only partially utilized here.

Figure 6:
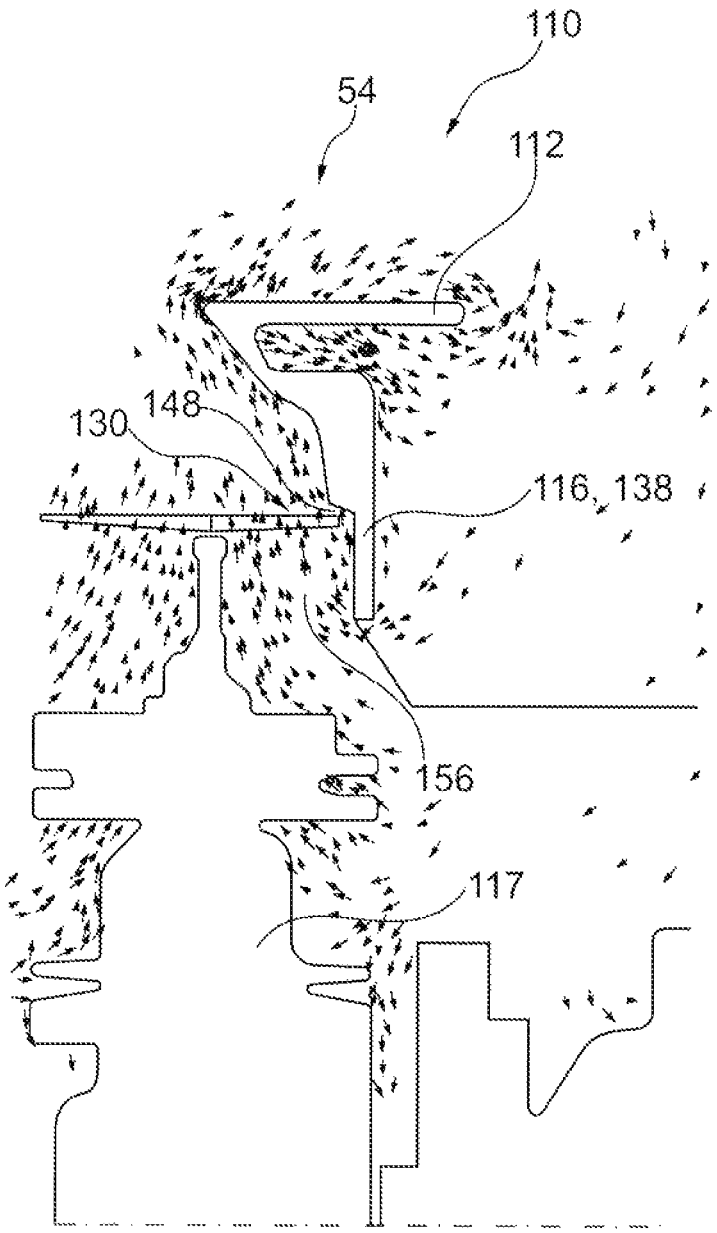
FIG. 6 shows a flow simulation in the fan according to an embodiment of the invention.

FIG. 6 shows a flow simulation 54 of the fan 110 according to the invention. The gap 148 is formed between the flange 116, more accurately between the flange-ring plane 138, and the top edge of the ribs 130. The displacement of the air shown by the arrows 156 is significantly less. The rib height of the ribs 130 can be fully utilized.

Overall, a return flow can be increased and therefore the cooling capacity of the fan clutch 117 can be further improved as a result of the contortion of the flange 116 and the formation of the gap 148 in the region of the flange-ring plane 138.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A fan clutch for a fan of a cooling system of a motor vehicle, the fan clutch comprising:

an annular flange connecting the fan, the flange being arranged centrally around an axis, the flange forming a flange-ring surface substantially perpendicular to the axis and has a flange-ring inner side and a flange-ring outer side that bound the flange-ring surface, the flange being contorted in the flange-ring surface in certain areas in a direction substantially parallel to the axis, wherein the flange-ring surface has first flange-ring planes and second flange-ring planes that alternate around the flange to form a continuous flange-ring surface, the first flange-ring planes and the second flange-ring planes each respectively extend from the flange-ring inner side to the flange-ring outer side, wherein the first flange-ring planes form the certain areas of the flange that are contorted in the direction substantially parallel to the axis, wherein each of the first flange-ring planes, on each side thereof, are connected to a respective one of the second flange-ring planes by a flange ring section, and wherein the flange-ring inner side has projections and/or recesses that are formed substantially uniformly over the circumference.

2. The fan clutch as claimed in claim 1, wherein the flange-ring surface has a substantially step-shaped form, wherein the flange ring section is an angled plane.

3. The fan clutch as claimed in claim 1, wherein the flange-ring surface has a substantially wave-shaped form.

4. The fan clutch as claimed in claim 1, wherein the first flange-ring planes and the second flange-ring planes form wave troughs and/or wave peaks.

5. The fan clutch as claimed in claim 1, wherein the projections and/or recesses are formed in the flange-ring surface.

6. A cooling system for a motor vehicle comprising the fan and the fan clutch as claimed in claim 1 for connecting the fan to a drive shaft of an engine.

7. The fan clutch as claimed in claim 1, further comprising a fan clutch housing, the axis being a housing axis of the fan clutch housing, wherein the fan clutch housing has cooling ribs radially oriented and mounted about the housing axis, wherein a gap is formed between the second flange-ring planes and the cooling ribs.

* * * * *